US005477707A

United States Patent [19]

Renda et al.

[11] Patent Number: 5,477,707

[45] Date of Patent: Dec. 26, 1995

[54] HIGH SPEED SINKER FOR CIRCULAR KNITTING MACHINES

[75] Inventors: Philip Renda; James A. Renda, both of Charlotte, N.C.

[73] Assignee: Monarch Knitting Machinery Corp., Glendale, N.Y.

[21] Appl. No.: 351,824

[22] Filed: Dec. 8, 1994

[51] Int. Cl.[6] ..... D04B 15/06

[52] U.S. Cl. ..... 66/93; 66/92; 66/107

[58] Field of Search ..... 66/9 R, 91, 92, 66/93, 104, 107, 217

[56] References Cited

U.S. PATENT DOCUMENTS

| | | | |
|---|---|---|---|
| 4,020,653 | 5/1977 | Mishcon et al. | 66/104 |
| 4,194,374 | 3/1980 | Guell | 66/93 |
| 4,535,608 | 8/1985 | Plath et al. | 66/9 R |
| 4,612,784 | 9/1986 | Plath | 66/9 R |
| 4,926,660 | 5/1990 | Takashi | 66/9 R |
| 4,989,421 | 2/1991 | Schmidt | 66/9 R |
| 5,010,744 | 4/1991 | Kawase et al. | 66/93 |

FOREIGN PATENT DOCUMENTS

| | | |
|---|---|---|
| 2085035 | 4/1982 | United Kingdom . |
| 2160901 | 2/1986 | United Kingdom . |

*Primary Examiner*—John J. Calvert
*Attorney, Agent, or Firm*—Bell, Seltzer, Park & Gibson

[57] ABSTRACT

A sinker having a sinker body and a butt for engaging a sinker cam. Upper and lower nibs protrude from the sinker body. A first throat is defined between the upper and lower nibs for receiving a yarn. First, second and third knitting platforms are defined by the sinker body beneath the lower nib. A second throat is defined by the lower nib and the second and third knitting platforms for controlling a yarn loop. The second platform may be closer to the first throat than the first platform, and the third platform may be closer to the first throat than the second platform. This progressive displacement of the second and third knitting platforms provides for quick rolling over of a needle latch due to the resultant elevated position of the yarn loop on the needle shaft at desired prints in the knitting operation. This advantage reduces dropped stitches, enables use of a shorter needle latch length while maintaining a desired stitch length at the tie-in, and facilitates higher machine operating speeds. The sinker butt may have spaced apart lateral cam engaging portions that are connected by a bridge so as to define an opening of substantially triangular shape having a vertex pointed toward the sinker body, so that the butt may withstand damage without causing further damage to the knitting machine due to breakage of a sinker butt.

30 Claims, 4 Drawing Sheets

HIGH SPEED SINKER FOR CIRCULAR KNITTING MACHINES

FIELD OF THE INVENTION

The invention relates to sinkers for circular knitting machines. In particular, the invention relates to sinkers for high speed knitting of fabric such as fleece in conjunction with latch knitting needles in a circular knitting machine.

BACKGROUND OF THE INVENTION

Circular knitting machines are often used for production of many different types of fabric. One type of fabric that is produced on such knitting machines is fleece fabric made up of fleece yarns, tie-in yarns and knit-in yarns. Since such knitting machines are usually employed in commercial knitting mills, it is often desirable that the machines be operated at a speed that is as high as possible for producing quality fabric without resulting in excessive machine breakage or down time, and without causing undesired fabric defects. This practice maximizes the amount of quality fabric that may be produced in a given amount of time, thus improving the profitability of the machine.

Heretofore, the operation of knitting machines has been restricted by limitations in the design of certain internal components of the machines which must be reciprocated at high speeds, and thus under conditions of high acceleration and wear, to produce fabric. A sinker is one such part that must be reciprocated quickly in the machine during operation. Likewise, the knitting needles which act in concert with the sinkers in the machine must be reciprocated quickly, and latches on the needles opened and closed rapidly, thus also leading to speed limitations. Both of these components are generally moved by cams having undulating tracks which are engaged by butts that are fixedly attached to the sinkers and needles.

One problematic aspect of the operation of knitting machines is the distance over which the needle must be retracted in order to roll over, or close, the latch of the needle during the knitting cycle. "Typically, the latch is rolled over by a previously knit loop of yarn that is positioned around the needle shaft. The position of this yarn loop is generally controlled by a knitting platform and/or throat of the sinker. Retraction of the needle past the knitting platform causes the loop to slide along the needle shaft and to move over the latch, thus rolling the latch over.

During knitting, it is desirable to close the arch as quickly as possible to prevent fabric defects such as dropped stitches, commonly known as "birds eye" or "cat face," which may result when torque in the yarn causes the yarn to twist out of the open hook of the needle in particular, dropped stitches may occur during fleece knitting when a tie-in yarn, which is typically looped loosely across the needle, "squirms" out of the needle hook before the latch is closed. Faster closing of the latch, therefore, reduces the occurrence of such fabric defects when the knitting machine is operated. Prior knitting machines, and the sinkers and needles installed in them, have not adequately solved the occurrence of dropped stitches.

Also, for the latch roll over to be accomplished properly, it is necessary that the latch length be selected so that the latch reaches the location of the previously knitted loop on the knitting platform at the proper time as the needle is retracted. This condition is due to the necessity that the needle must be retracted a predetermined distance, which takes time, in order for the latch to be rolled over. Therefore, the combination of the latch length and the position of the knitting platform may affect the speed of the knitting machine.

For example, the model 4FST fleece knitting machine, which was manufactured in the early 1980's by the Vanguard Supreme Division of Monarch Knitting Machinery Corporation, Monroe, N.C., used a sinker having a linear knitting platform for controlling the position of previously knitted loops of fabric. In this machine, a latch length of about 9.5 mm was used, which permitted an operating speed factor of about 630, which equals about 21 revolutions per minute for a thirty inch (30") diameter knitting machine.

In a successive model, the 4SFT/2 fleece knitting machine, which was made and sold by the Vanguard Supreme Division in about 1985, the knitting platform of the sinkers was characterized by two levels. One level of the knitting platform was further removed from the top throat of the sinker, and the other level was positioned closer to the top throat. In this machine, a latch length is 8.0 mm. This development improved operating speeds somewhat, enabling the 4FST/2 machine to be operated at a speed factor of about 720 (i.e., about 24 revolutions per minute for a 30" diameter knitting machine). This division of the knitting platform into two levels permitted the latch length to be shortened somewhat by positioning the yarn loop on the elevated level of the platform closer to the top throat of the sinker; however, the amount by which the single elevated portion of the knitting platform could be removed from the lower knitting platform was limited, as further removal of the two platforms from each other would affect the stitch length of the knitting machine. Also, yarn defects could still result from machine operation, since the yarns could still twist out of the hooks, causing dropped stitches.

Another characteristic of high speed operation of knitting machines is the likelihood of component breakage due to high stresses imparted to the internal parts of the machine, or due to inadvertent introduction of foreign matter into the working parts of the machine that impedes their function. For example, high speed operation of knitting machines requires that the sinkers in the machine reciprocate very quickly. The sinkers are generally caused to reciprocate by cooperation of a butt portion of the sinker with a cam having an undulating track through which the butt moves. This arrangement leads to high acceleration of the sinkers, since the direction of travel of the sinkers is rapidly reversed. Consequently, high stresses are imposed on parts of the sinkers, particularly at the butt, and on other related components of the knitting machine.

Heretofore, breakage of a sinker butt within the closed confines of the knitting machine cam has been prone to cause relatively disastrous results. For example, breakage of one butt in one sinker in known knitting machines is likely to break other butts adjacent to and downstream of a first broken butt. In extreme cases, such breakage may lead to breakage or damage of the knitting machine cams or other components. Such events have therefore frequently necessitated that operation of the machine be stopped for relatively extended time periods so that the machine may be repaired and new components such as sinkers installed. Of course, repair of such damage and replacement of parts may be expensive. Also, the down time necessitated for such repair and replacement activities interferes with the productivity of the knitting machine.

In accordance with the foregoing, one object of the present invention is to provide a sinker for use in a circular knitting machine that will cause the latch of a needle acting in concert with the sinker to be closed more quickly than in prior knitting machines so as to reduce fabric defects such as "birds eye" or "cat face" due to yarn being twisted out of the needle hook due to yarn torque.

Another object of the present invention is to provide a sinker for use in a circular knitting machine which facilitates increased machine operating speeds in conjunction with needles having a desired latch length.

A further object of the present invention is to provide a sinker for use in a circular knitting machine for high speed production of fleece fabric.

Another object of the present invention is to provide a sinker for high speed production of fleece fabric in a circular knitting machine.

Yet another object of the present invention is to provide a sinker for use in high speed production of fleece fabric on a circular knitting machine with knitting needles having short latches.

A still further object of the present invention is to provide a sinker for use in a circular knitting machine that has a butt for reducing the likelihood of damaging other sinkers or components of the knitting machine in the event that the butt is damaged.

A further object of the present invention is to provide a sinker having a butt designed to deform or break partially instead of breaking fully in the event of encountering an obstruction in the sinker cam, so as to reduce the likelihood of damaging other sinkers or components of the knitting machine.

A still further object of the present invention is to provide a sinker for reducing down time of the knitting machine due to broken sinker butts.

SUMMARY OF THE INVENTION

The above and other objects and advantages of the present invention are achieved in the embodiment described herein by the provision of a sinker for use in a circular knitting machine. The sinker has a sinker body and a butt that extends from the sinker body for engaging a sinker cam in the knitting machine for moving the sinker between extended, intermediate and retracted positions in the knitting machine.

An upper nib protrudes from the sinker body. A lower nib also protrudes from the sinker body and extends further from the body than the upper nib protrudes from the body. A first throat is defined between the upper and lower nibs so as to have an open end for receiving a fleece yarn and a closed end for retaining the received fleece yarn. First, second and third knitting platforms are also defined by the sinker body, such that the first knitting platform extends beyond the lower nib. A second throat having an open end for receiving a loop and a closed end for retaining the previously knit loop is defined by the lower nib and the second and third knitting platforms for controlling a yarn loop of a previous course knitted by the knitting machine. Each of the first and second throats may be of substantially uniform width.

The second knitting platform may be closer to the first throat than the first knitting platform, and the third knitting platform may be closer to the first throat than the second knitting platform, such that when the sinker is moved to the intermediate position in the knitting machine, the previously knit loop is maintained on the second platform so as to roll over the latch of a needle in the knitting machine without passing over the head of the needle when the needle retracts to pull a tie-in yarn past the fleece yarn received by the first throat to form a new tie-in loop. Likewise, when the sinker is moved to the extended position, the previously knit loop may be maintained on the third platform so as to roll over the latch of the needle and pass over the head of the needle when the needle retracts to pull the new tie-in loop and a knitting yarn through the previously knit loop. Also, when the sinker is moved to the retracted position, the previously knit loop is maintained on the first platform so that further retraction of the needle pulls the new tie-in loop and knit-in yarn off the nibs and further through the previously knit loop. Thus, the placement of the first, second and third platforms with respect to the first throat reduces the distance over which the knitting needle must retract to cause the previously knit loop at the third platform to roll over the latch. The relative placement of the knitting platforms also maintains a desired stitch range longer than would be defined if the first and second platforms were collinear with the third platform. These features enable the knitting machine to operate at high speed while maintaining a desired stitch range, and they position the previously knitted yarn loop for rolling over the needle latch more quickly so as to reduce fabric defects caused by yarn twisting out of the needle hook due to torque in the yarn.

In one embodiment, the second knitting platform may be about 0.040 inch closer to the first throat than the first knitting platform, and the third knitting platform may be about 0.035 inch closer to the first throat than the second knitting platform.

The sinker may include means in the butt for permitting the butt to deform without breaking fully away from the sinker body when an obstruction is encountered in the sinker cam or when the butt is damaged from excessive stress due to machine operation. Thus, the likelihood that damage to the butt will cause still further damage to other butts or other components of the knitting machine is reduced. In a preferred embodiment, the deformable means in the butt includes lateral cam engaging portions that extend from the sinker body and which are spaced apart from each other so as to be substantially independently deformable and frangible from the sinker body. A connector bridge may also extend between the lateral portions so as to define an opening between the portions, the sinker body, and the connector bridge. Thus, if either of the lateral portions is broken from the sinker body or deformed by an encounter with an obstruction in the track of the sinker cam or due to stress, the connector bridge retains the broken or deformed portion to the other lateral portion. In one embodiment, the connector bridge, lateral portions and sinker body define a substantially triangular opening having a vertex pointed toward the sinker body and base of the butt. The connector bridge may be deformable.

One or more of the sinkers may be provided in a circular knitting machine having a sinker cam for moving the sinkers. Knitting needles having a latch, a head end, and a hook for engaging yarns and loops in concert with the sinkers may also be provided in the machine. In one embodiment, the latches of the needles may be about 7 mm long.

BRIEF DESCRIPTION OF THE DRAWINGS

The foregoing and other objects, advantages and features of the invention, and the manner in which the same are accomplished, will become apparent from the following detailed description of the invention taken in conjunction with the accompanying drawings which illustrate a preferred and exemplary embodiment, wherein.

DESCRIPTION OF THE PREFERRED EMBODIMENT

Figure 2:
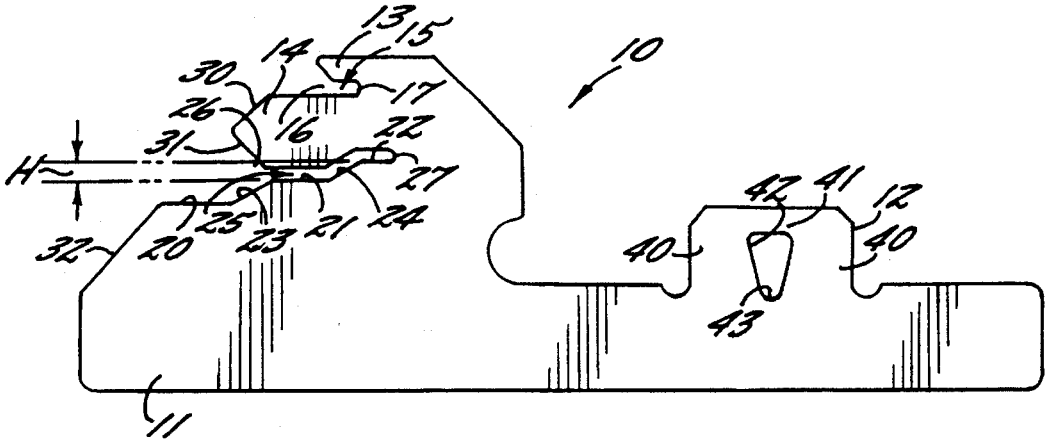
FIG. 2 is a side elevation view of a sinker made in accordance with the principles of the present invention.

Referring now to the drawings, FIG. 2 is an elevation view of one embodiment of a new sinker for use in a circular knitting machine, the sinker being designated generally at 10. The sinker 10 is adapted particularly for high speed production of fleece fabric comprised of a lay-in, or fleece yarn F, a tie-in yarn T, and a knit-in yarn G, all as designated at FIGS. 3–10. However, the sinker may also be useful for other types of knitting, such as knitting of jersey fabrics.

Referring again to FIG. 2, the sinker 10 includes a sinker body 11 and a butt 12 extending from the sinker body 11. The butt 12 is adapted for engaging a sinker cam 44 in the knitting machine. As shown in cross-section in FIG. 1, the sinker cam 44 may have a recessed portion, or track, which defines an undulating path into which the sinker butt 12 may be fitted. The undulating path defined by the sinker cam contacts the edges of the butt 12 so as to cause the sinker 10 to move between extended, generally intermediate and retracted positions in the knitting machine, as indicated schematically by the lower position line in FIG. 1.

Figure 4:
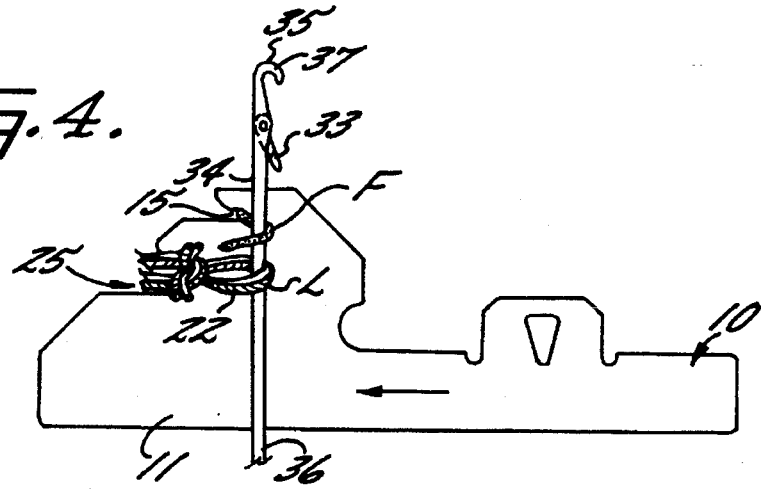
FIG. 4 is an environmental elevation view of a sinker made in accordance with the present invention at the point in the knitting cycle in which the sinker moves into an extended position in the knitting machine so that the position of the fleece yarn is controlled by the first throat and so that the position of the previously knit loop is controlled by the second throat.

Again referring to FIG. 2, the sinker 10 includes an upper nib 13 which protrudes from the sinker body 11, and a lower nib 14 which also extends from the sinker body 11. The lower nib 14 extends further from the sinker body 11 than the upper nib 13 extends from the sinker body 11. The upper and lower nibs 13 and 14 define a first throat 15, which has an open end 16 and a closed end 17 for receiving and retaining a fleece yarn F, as illustrated in FIG. 4.

Again referring to FIG. 2, first, second and third knitting platforms 20, 21 and 22, respectively, are defined by the sinker body 11. The platforms 20, 21 and 22 are interconnected by inclined edges 23 and 24. The first knitting platform 20 extends beyond the lower nib 14.

The lower nib 14 and second and third knitting platforms 21 and 22 define a second throat 25. The second throat 25 has an open end 26 and a closed end 27 for receiving a loop of a previous course knitted by the knitting machine and for retaining the previously knit loop. In a preferred embodiment, each of the first and second throats 15 and 25 is of substantially uniform width. The second knitting platform 21 may be closer to the first throat 15 than the first knitting platform 20. Likewise, the third knitting platform 22 may be closer to the first throat 15 than the second knitting platform 21.

In a preferred embodiment, the second knitting platform 21 is about 0.040 inch closer to the first throat 15 than the first knitting platform 20. Likewise, the third knitting platform 22 may be about 0.035 inch closer to the first throat 15 than the second knitting platform 21, as illustrated by the dimension H in FIG. 2.

The lower nib 14 may have a front, upwardly inclined nib pawl 30 and a lower, inwardly inclined edge 31 which leads towards the second throat 25. Also, the sinker body 11 may define a sinker pawl 32 underlying the first platform 20.

Figure 6:
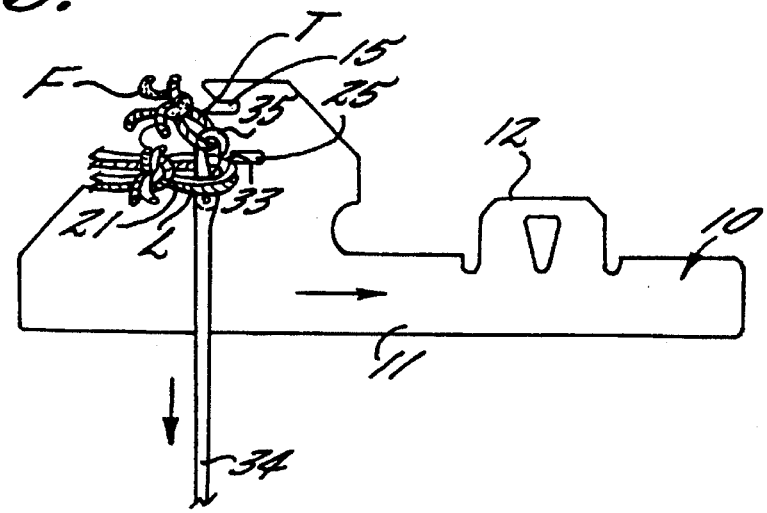
FIG. 6 is an environmental elevation view of a sinker made in accordance with the present invention at the point in the knitting cycle in which the sinker moves to an intermediate position so that the position of the previously knitted loop is controlled by the second throat at the third knitting platform so as to roll over the needle latch as the needle is retracted without passing over the needle head, when the needle is retracted to pull the tie-in yarn past the fleece yarn to form a new tie-in yarn loop.

The arrangement of the first and second throats 15 and 25 and the first, second and third knitting platforms 20, 21 and 22 permits the sinker 10 to be moved between extended, retracted and generally intermediate positions in the knitting machine for knitting of fabrics such as fleece fabric comprised of lay-in, tie-in and jersey yarns. When the sinker 10 is moved to the intermediate position in the knitting machine, the loop of the previously knit course is maintained on the second platform 21 of the sinker 10, so as to roll over the latch 33 of a knitting needle 34 as the needle 34 is drawn downward past the loop of the previously knit course, as best illustrated in FIG. 6. Thus, the needle 34 may retract so that the yarn of the previously knit course does not pass over the head 35 of the needle 34. When the sinker 10 is moved to the generally extended position in the knitting machine, the previously knitted loop is controlled on the third platform 22 in the throat 25 so as to roll over the latch 33 of a needle 34 more quickly as the needle 34 is retracted.

Figure 3:
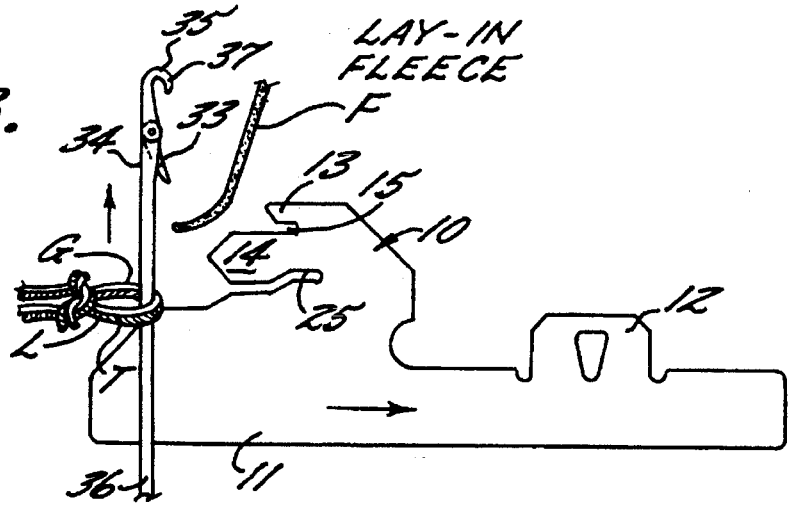
FIG. 3 is an environmental elevation view of a sinker made in accordance with the present invention at the point in the knitting cycle in which the sinker is in a retracted position and at which a fleece yarn is introduced to a select knitting needle associated with the sinker.

Operation of a knitting machine in which the sinker 10 of the present invention is installed is advantageous, particularly with respect to production of fleece fabric having a lay-in fleece yarn F, a tie-in yarn T, and a knit-in yarn G, as best illustrated in FIGS. 3–10. FIG. 3 shows the sinker 10 moved to a retracted position in the knitting machine (not shown) with respect to a latch knitting needle 34 associated with the sinker 10. In this figure, a loop L of a previously knitted course of fabric is received on the shaft 36 of the knitting needle 34. The loop L is comprised of a previously knit portion of the knit-in yarn G and the tie-in yarn T. On a select needle 34, a lay-in fleece yarn F may also be associated with the loop L. Also, the needle 34 is a positioned in a relatively extended position with respect to the sinker 10 so that a portion of the shaft 36 of the needle 34 may be moved into engagement with a lay-in fleece yarn F. In fleece knitting typically, only one of every several knitting needles is a "select" needle used to engage the lay-in fleece yarn F.

As shown in FIG. 4, the sinker 10 moves forward into an extended position in the knitting machine, while the height of the needle 34 remains substantially unchanged. The change in the positions of the sinker 10 and the needle 34 is illustrated schematically in FIG. 1, in which the upper position line represents movement of the needle 34 and the lower position line represents movement of the sinker 10. Referring still to FIG. 4, the lay-in fleece yarn F is received on the shaft 36 of the needle 34 and is further received within the first throat 15 of the sinker 10 so as to control the position of the lay-in fleece yarn F along the shaft 36 of the needle 34. Likewise, the position of the previously knit loop n on the shaft 36 is controlled by the second throat 25 of the sinker 10.

Figure 1:
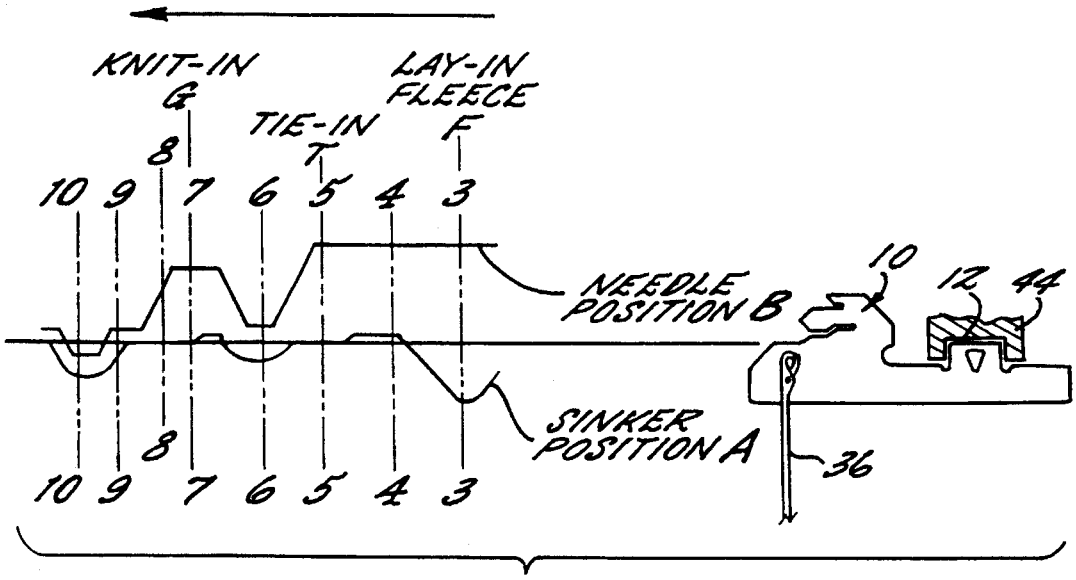
FIG. 1 is a schematic diagram illustrating the positions of the sinker and an associated knitting needle in the knitting machine during the knitting cycle, which is marked to correspond with the positions of the sinker and as associated needle shown in each of the FIGS. 3 through 10 and which also includes an environmental view of a sinker of the present invention fitted into a sinker cam.
Figure 5:
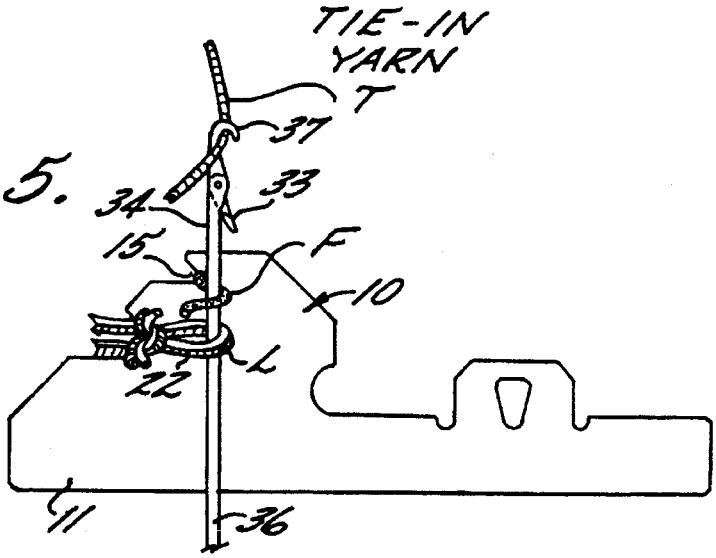
FIG. 5 is an environmental elevation view of a sinker made in accordance with the present invention at the point in the knitting cycle in which the sinker remains in an extended position in the knitting machine so that the position of the fleece yarn is controlled by the first throat and the position of the previously knitted loop is controlled by the second throat while the knitting needle engages a tie-in yarn.

Referring now to FIG. 5, the sinker 10 remains in a relatively extended position (which may, as shown in FIG. 1, be slightly retracted from the fully extended position shown in FIG. 4) so that the first and second throats 15 and 25 control the position of the fleece yarn F and previously knitted loop L on the shaft 36 of the needle 34. The hook 37 of the needle 34 engages a tie-in yarn T in this portion of the knitting operation.

Moving to FIG. 6, the sinker 10 is shown moved into an intermediate position (see FIG. 1) so that the position of the previously knitting loop L is controlled by the second throat 25 above the second knitting platform 21. The needle 34 retracts at this point (see FIG. 1) so that the previously knitted loop n slides along the shaft 36 of the needle 34 and closes the latch 33 without passing over the head 35 of the needle 34. Here, the tie-in yarn T is pulled by the needle 34 past the fleece yarn F to form a new tie-in yarn loop.

Figure 7:
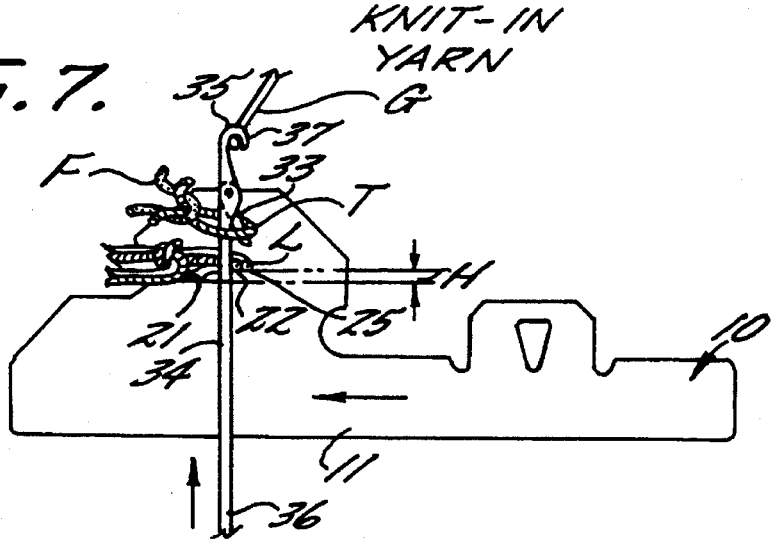
FIG. 7 is an environmental elevation view of a sinker made in accordance with the present invention at the point in the knitting cycle in which the sinker again moves to an extended position in the knitting machine so that the position of the loop of the previously knitted course is controlled by the second throat at the third knitting platform, and so that the looped fleece and tie-in yarns are controlled by the first throat to open the needle latch as the needle extends upwardly to engage a knit-in yarn.

FIG. 7 shows the next step in the knitting operation. Here, the sinker 10 is shown moved again to an extended position so that the position of the previously knitted loop n is controlled by the second throat 25 above the third knitting platform 22 with respect to the shaft 36 of the needle 34. At this point, the hook 37 of the needle 34 engages a knit-in yarn G. As the needle moves upwardly from the position shown in FIG. 6 to the position shown in FIG. 7, the second throat 25 controls the position of the previously knitted loop L so that the loop L slides downwardly along the shaft 36. Likewise, the first throat 15 controls the position of the newly looped tie-in yarn T so as to open the latch 33 without moving the looped tie-in yarn T off of the latch 33 and on to the shaft 36. Thus, the needle 34 goes into a tuck position in which the yarn T remains on the open latch 33 so that the hook 37 is exposed to engage a new knitting yarn G, as shown in FIG. 7.

Figure 8:
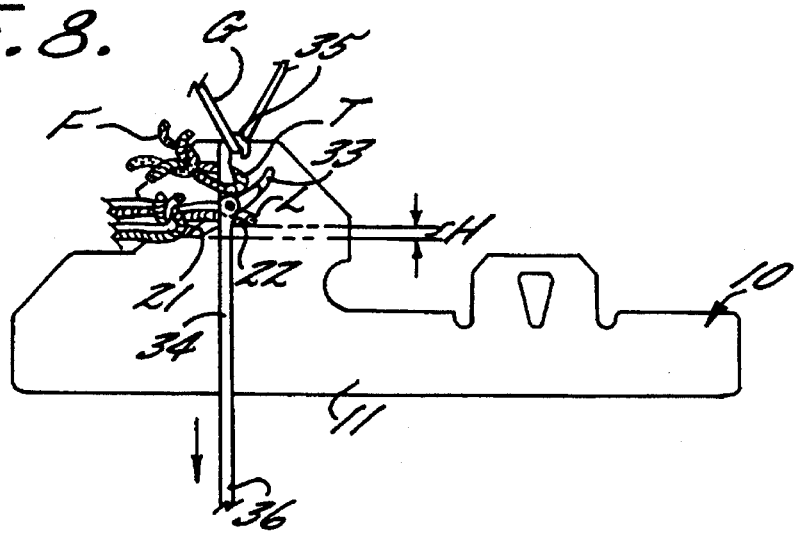
FIG. 8 is an environmental elevation view of a sinker made in accordance with the present invention at the point in the knitting cycle in which the sinker remains in an extended position so that the position of the loop of the previously knitted course is controlled by the second throat at the third knitting platform, and so that the looped fleece and tie-in yarns are controlled by the first throat as the needle draws the knit-in yarn toward the fleece and tie-in yarns.

Moving on to FIG. 8, the sinker 10 remains in the extended position in the knitting machine (see FIG. 1) as the needle 34 is retracted downwardly so as to pull the knit-in yarn G toward the sinker 10. The position of the previously knitted loop n is again maintained by the second throat 25 above the third knitting platform 22 so as to engage the bottom portion of the latch 33 and move it into a closed position against the hook 37. Meanwhile, the looped tie-in yarn T is maintained within the hook 37 and latch 33, along with the newly engaged knit-in yarn G. This positioning of the previously knitted loop L of the twice elevated third knitting platform 22, as shown by the displacement H in FIG. 8, encourages fast closing of the latch 33.

The elevated position of the third knitting platform 22 has the advantage of causing the latch 33 to close more quickly as the needle 34 is retracted. This advantage is realized because the third elevated knitting platform 22 maintains the knitted loop L higher on the shaft 36 of the needle 34, while the tie-in yarn T, which is typically looped loosely over the needle 34, is positioned by the first throat 15. Thus, as the needle 34 is retracted, the latch 33 is closed earlier, or more quickly, than it would be if the loop L were maintained at the level of the first or second platforms 20 or 21. This faster, or earlier, closing of the latch 33 traps the yarn T in the hook 34, therefore preventing the yarn T from "squirming" out of and over the hook 35, which is undesirable, as it would result in a dropped stitch, otherwise known as "cat facing" or "birds eye." Thus, the invention provides a solution for the problem of birds eye formation in knitting.

In addition, use of the elevated platforms 20, 21 and 22 in combination with a needle having a shorter latch length of 7 mm also provides for higher machine operating speeds. It has been found that the combination of a sinker 10 and a 7 mm latch needle enables a knitting machine to operate an a speed factor of about 1000.

Figure 9:
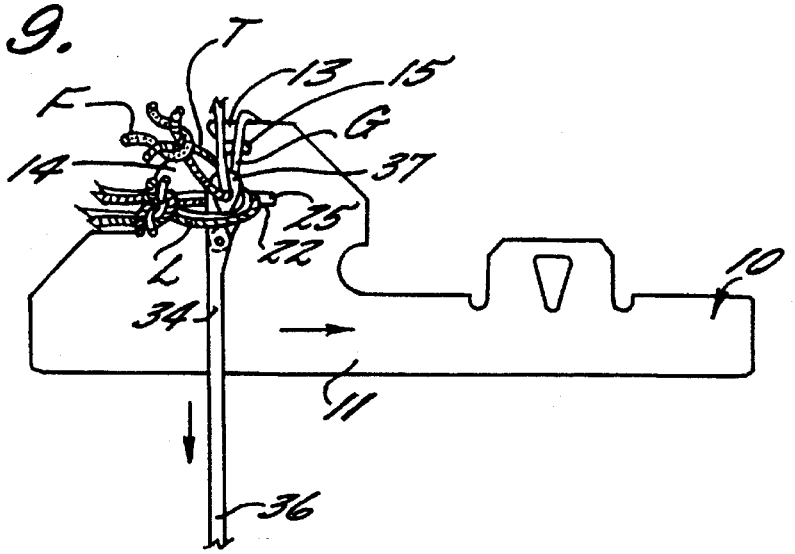
FIG. 9 is an environmental elevation view of a sinker made in accordance with the present invention at the point in the knitting cycle in which the sinker moves to an intermediate position so that the position of the loop of the previously knitted course is controlled by the second throat at the third knitting platform to roll over the knitting needle latch, and so that the looped fleece and tie-in yarns and the knit-in yarn are drawn down toward the loop of the previously knit course.
Figure 10:
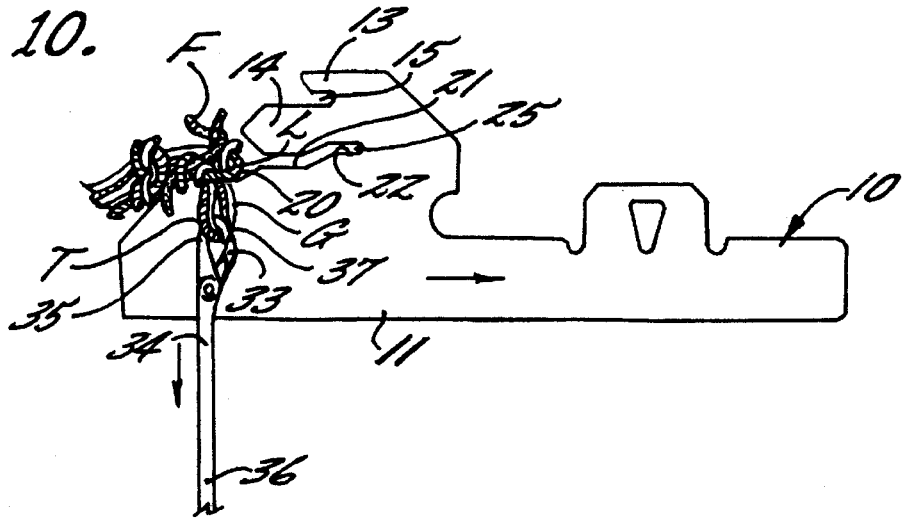
FIG. 10 is an environmental elevation view of a sinker made in accordance with the present invention at the point in the knitting cycle in which the sinker moves to a retracted position so that the needle draws the knit-in yarn off of the upper and lower nibs and further pulls the tie-in and knit-in yarns through the loop of the previously knit course at the first knitting platform.

FIG. 9 shows that the sinker then moves from the extended position shown in FIG. 8 towards the retracted position ultimately shown in FIG. 10. in FIG. 9, the knit-in yarn G and looped tie-in yarn T are retained within the hook 37 of the needle 34 and are pulled toward the previously knitted loop L, which is maintained on the second knitting platform 21 of the second throat 25. Here, the knit-in yarn G is pulled across the top of the upper nib 13. Further retraction of the sinker 10 and further retraction of the needle 34 are illustrated in FIG. 10. Here, the previously knitted loop slips over the head 35 of the needle 34 and moves out of the second throat 25 so as to be positioned above the first knitting platform 20. Also, the knit-in yarn G slips off of the nibs 13 and 14 and is drawn through the previously knitted loop L to form a new loop. The fleece yarn F is not pulled through the previously knitted loop L, as shown in FIG. 10. Thus, a new loop is formed, and the previously knitted loop L falls away as knitted fabric. The knitting cycle is repeated when the sinker 10 and needle 34 are moved again to the position shown in FIG. 3.

The invention also permits use of a shorter latch length than would otherwise be possible while maintaining a desired stitch length. Since the position of the third knitting platform 22 is closer to the first throat 15 than are the first and second platforms 20 and 21, the longer stitch range at the tie-in position defined above platforms 20 and 21 is not last. Such stitch range would, however, be compromised if the platforms 20 and 21 were positioned higher so as to be collinear with the third platform 22.

The butt 12 of the sinker 10 may also include means for permitting the butt 12 to deform without breaking fully away from the sinker body 11 when an obstruction is encountered in the sinker cam 44, or when the butt is damaged by fatigue or excessive stress due to operation of the machine, so as to reduce the occurrence of damage to other components of the knitting machine such as other sinkers positioned downstream of the sinker 10. As shown in FIG. 2, the deformable means may include lateral cam engaging portions 40. One such lateral cam engaging portion 40 may be located at each side of the butt 12. The lateral portions 40 may be spaced apart from each other so as to be substantially independently deformable and frangible from the sinker body 11. A connector bridge 41 may extend between the lateral portions 40 so as to define an opening 42 between the lateral portions 40, the connector bridge 41 and the sinker body 11. Thus, if any one of the lateral portions 40 is deformed or broken from the sinker body 11, it will be retained by the connector bridge 41 to the other lateral portion 40 and to the body 11 of the sinker 10.

In a preferred embodiment, the connector bridge 41, lateral portions 40 and sinker body 11 define an opening 42 that is substantially triangular in shape and which has one vertex 43 pointed towards the sinker body 11 at the base of the butt 12. The connector bridge 41 may be deformable. However, the opening 42 may be defined so as to have other shapes.

In the drawings and specification, there has been disclosed a typical preferred embodiment of the invention. Although specific terms have been employed, they have been used in a generic and descriptive sense only and not for purposes of limitation, the scope of the invention being set forth in the following claims.

That which is claimed is:

1. A sinker for use in a circular knitting machine, comprising:

a sinker body;

a butt extending from said sinker body for engaging a sinker cam in the knitting machine for moving said sinker between extended, intermediate and retracted positions in the knitting machine;

an upper nib protruding from said sinker body;

a lower nib protruding from said sinker body and extending further from said body than said upper nib;

a first throat defined between said upper and lower nibs, said first throat having an open end for receiving a fleece yarn and a closed end for retaining the received fleece yarn;

first, second and third knitting platforms defined by said sinker body, said first knitting platform extending beyond said lower nib; and a second throat for controlling a yarn loop of a previous course knitted by the knitting machine, said second throat having an open end for receiving a loop and a closed end for retaining the previously knit loop, said second throat being defined by said lower nib and said second and third knitting platforms.

2. A sinker as defined in claim 1 wherein each said first and second throat is of substantially uniform width.

3. A sinker as defined in claim 2 wherein said second knitting platform is closer to said first throat than said first knitting platform, and wherein said third knitting platform is closer to said first throat than said second knitting platform, such that when said sinker is moved to the intermediate position in the knitting machine, the previously knit loop is maintained on said second platform so as to roll over the latch of a needle in the knitting machine without passing over the head of the needle when the needle retracts to pull a tie-in yarn past the fleece yarn received by said first throat to form a new tie-in loop; and such that when said sinker is moved to the extended position, the previously knit loop is maintained on said third platform so as to roll over the latch of the needle and pass over the head of the needle when the needle retracts to pull the new tie-in loop and a knit-in yarn through the previously knit loop; and such that when said sinker is moved to the retracted position, the previously knit loop is maintained on said first platform so that further retraction of the needle pulls the new tie-in loop and knit-in yarn off said nibs and further through the previously knit loop; whereby said placement of said first, second and third platforms with respect to said first throat reduces the distance over which the knitting needle must retract to cause the previously knit loop at the third platform to roll over the needle latch quickly to prevent dropped stitches, and further whereby said placement maintains a desired stitch range longer than would be defined if said first and second platforms were collinear with said third platform, thus enabling the knitting machine to operate at high speed without fabric defects and while maintaining a desired stitch range.

4. A sinker platform as defined in claim 3 wherein said second knitting platform is about 0.040 inch closer to said first throat than said first knitting platform, and further wherein said third knitting platform is about 0.035 inch closer to said first throat than said second knitting platform.

5. A sinker as defined in claim 1 further comprising means in said butt for permitting said butt to deform without breaking fully away from said sinker body when an obstruction is encountered in the sinker cam, so that said butt may withstand damage without causing further damage to other components of the knitting machine.

6. A sinker as defined in claim 5 wherein said deformable means in said butt comprises lateral cam engaging portions extending from said sinker body, said lateral portions being spaced apart from each other so as to be substantially independently deformable and frangible from said sinker body, and a connector bridge extending between said lateral portions so as to define an opening between said portions, said sinker body, and said connector bridge, whereby any said lateral portion that is broken from said sinker body is retained to said other lateral portion by said connector bridge.

7. A sinker as defined in claim 6 wherein said connector bridge, lateral portions and sinker body define a substantially triangular opening having a vertex pointed toward said sinker body.

8. A sinker as defined in claim 6 wherein said connector bridge is deformable.

9. A sinker for use in a circular knitting machine, comprising:

a sinker body;

a butt extending from said sinker body for engaging a sinker cam in the knitting machine for moving said sinker between extended, intermediate and retracted positions in the knitting machine;

an upper nib protruding from said sinker body;

a lower nib protruding from said sinker body and extending further from said body than said upper nib;

a first throat defined between said upper and lower nibs, said first throat having an open end for receiving a fleece yarn and a closed end for retaining the received fleece yarn;

first, second and third knitting platforms defined by said sinker body and being interconnected by inclined edges of said sinker body, said first knitting platform extending beyond said lower nib;

a second throat for controlling a yarn loop of a previous course knitted by the knitting machine, said second throat having an open end for receiving a loop and a closed end for retaining the previously knit loop, said second throat being defined by said lower nib and said second and third knitting platforms;

said second knitting platform being closer to said first throat than said first knitting platform, and said third knitting platform being closer to said first throat than said second knitting platform, such that when said sinker is moved to the intermediate position in the knitting machine, the previously knit loop is maintained on said second platform so as to roll over the latch of a needle in the knitting machine without passing over the head of the needle when the needle retracts to pull a tie-in yarn past the fleece yarn received by said first throat to form a new tie-in loop; and such that when said sinker is moved to the extended position, the previously knit loop is maintained on said third platform so as to roll over the latch of the needle quickly to prevent dropped stitches and pass over the head of the needle when the needle retracts to pull the new tie-in loop and a knitting yarn through the previously knit loop; and such that when said sinker is moved to the retracted position, the previously knit loop is maintained on said first platform so that further retraction of the needle pulls the new tie-in loop and knit-in yarn off said nibs and further through the previously knit loop;

whereby said placement of said first, second and third platforms with respect to said first throat reduces the distance over which the knitting needle must retract to cause the previously knit loop at said third platform to roll over the needle latch, and further whereby said placement of said third platform relative to said first and second platforms maintains a desired stitch range longer than would be defined if said first and second platforms were collinear with said third platform, thus enabling the knitting machine to operate at high speed without fabric defects and while maintaining a desired stitch range.

10. A sinker as defined in claim 9 further comprising means in said butt for permitting said butt to deform without breaking fully away from said sinker body when an obstruction is encountered in the sinker cam, so as to reduce the occurrence of damage to components of the knitting machine.

11. A sinker as defined in claim 10 wherein said deformable means in said butt comprises lateral cam engaging portions extending from said sinker body, said lateral portions being spaced apart from each other so as to be substantially independently deformable and frangible from said sinker body, and a connector bridge extending between said lateral portions so as to define an opening between said portions, said sinker body, and said connector bridge, whereby any said lateral portion that is broken from said sinker body is retained to said other lateral portion by said connector bridge.

12. A sinker as defined in claim 11 wherein said connector bridge, lateral portions and sinker body define a substantially triangular opening having one apex pointed toward said sinker body.

13. A sinker as defined in claim 12 wherein said connector bridge is deformable.

14. A sinker for use in a circular knitting machine, comprising:

a sinker body;

a butt extending from said sinker body for engaging a sinker cam in the knitting machine; and means in said butt for permitting said butt to deform without breaking fully away from said sinker body when an obstruction is encountered in the sinker cam, so that said butt may withstand damage without causing damage to other components of the knitting machine.

15. A sinker as defined in claim 14 wherein said deformable means in said butt comprises lateral cam engaging portions extending from said sinker body, said lateral portions being spaced apart from each other so as to be substantially independently deformable and frangible from said sinker body, and a connector bridge extending between said lateral portions so as to define an opening between said portions, said sinker body, and said connector bridge, whereby any said lateral portion that is broken from said sinker body is retained to said other lateral portion by said connector bridge,

16. A sinker as defined in claim 15 wherein said connector bridge, lateral portions and sinker body define a substantially triangular opening having one vertex pointed toward said sinker body.

17. A sinker as defined in claim 16 wherein said connector bridge is deformable.

18. A sinker for use in a circular knitting machine, comprising:

a sinker body;

lateral cam engaging portions extending from said sinker body for engaging a sinker cam in the knitting machine, said lateral portions being spaced apart from each other so as to be substantially independently deformable and frangible from said sinker body; and a connector bridge extending between said lateral portions so as to define an opening between said portions, said sinker body, and said connector bridge, whereby any said lateral portion that is broken from said sinker body is retained to said other lateral portion by said connector bridge.

19. A sinker as defined in claim 18 wherein said connector bridge, lateral portions and sinker body define a substantially triangular opening having one vertex pointed toward said sinker body.

20. A sinker as defined in claim 18 wherein said connector bridge is deformable.

21. A circular knitting machine for production of fleece fabric, comprising:

a knitting needle having a latch and a head;

a sinker cam; and a sinker, comprising:

a sinker body;

a butt extending from said sinker body for engaging said sinker cam to move said sinker between extended, intermediate and retracted positions in said knitting machine;

an upper nib protruding from said sinker body;

a lower nib protruding from said sinker body and extending further from said body than said upper nib;

a first throat defined between said upper and lower nibs, said first throat having an open end for receiving a fleece yarn and a closed end for retaining the received fleece yarn;

first, second and third knitting platforms defined by said sinker body and being interconnected by inclined edges of said sinker body, said first knitting platform extending beyond said lower nib; and a second throat for controlling a yarn loop of a previous course knitted by said knitting machine, said second throat having an open end for receiving a loop and a closed end for retaining the previously knit loop, said second throat being defined by said lower nib and said second and third knitting platforms.

22. A circular knitting machine as defined in claim 21 wherein each said first and second throat of said sinker is of substantially uniform width.

23. A circular knitting machine as defined in claim 22 wherein said second knitting platform of said sinker is closer to said first throat than said first knitting platform, and wherein said third knitting platform is closer to said first throat than said second knitting platform; such that when said sinker is moved to the intermediate position in said knitting machine, the previously knit loop is maintained on said second platform so as to roll over said needle latch without passing over said needle head when said needle retracts to pull a tie-in yarn past the fleece yarn received by said first throat to form a new tie-in loop; and such that when said sinker is moved to the extended position, the previously knit loop is maintained on said third platform so as to roll over said needle latch and pass over said needle head when said needle retracts to pull the new tie-in loop and a knit-in yarn through the previously knit loop; and such that when said sinker is moved to the retracted position, the previously knit loop is maintained on said first platform so that further retraction of said needle pulls the new tie-in loop and knit-in yarn off said nibs and further through the previously knit loop; whereby said placement of said first, second and third platforms with respect to said first throat reduces the distance over which said needle must retract to cause the previously knit loop at said third platform to roll over said needle latch quickly to prevent dropped stitches and further whereby said placement maintains a desired stitch range longer than would be defined if said first and second platforms were collinear with said third platform, thus enabling said knitting machine to operate at high speed without fabric defects and while maintaining a desired stitch range.

24. A circular knitting machine as defined in claim 23 wherein said second knitting platform of said sinker is about 0.040 inch closer to said first throat than said first knitting platform, and further wherein said third knitting platform is about 0.035 inch closer to said first throat than said second knitting platform.

25. A circular knitting machine as defined in claim 21 further comprising means in said butt for permitting said butt to deform without breaking fully away from said sinker body when an obstruction is encountered in said sinker cam, so as to reduce the occurrence of damage to said knitting machine.

26. A circular knitting machine as defined in claim 25 wherein said deformable means in said butt comprises lateral cam engaging portions extending from said sinker body, said lateral portions being spaced apart from each other so as to be substantially independently deformable and frangible from said sinker body, and a connector bridge extending between said lateral portions so as to define an opening between said portions, said sinker body, and said connector bridge, whereby any said lateral portion that is broken from said sinker body is retained to said other lateral portion by said connector bridge.

27. A circular knitting machine as defined in claim 26 wherein said connector bridge, lateral portions and sinker body define a substantially triangular opening having one vertex pointed toward said sinker body.

28. A circular knitting machine as defined in claim 27 wherein said connector bridge is deformable.

29. A circular knitting machine as defined in claim 21 wherein said needle latch is about 7 mm long.

30. A circular knitting machine for production of fleece fabric, comprising:

a knitting needle having a latch and a head, said latch being about 7 mm long;

a sinker cam; and a sinker, comprising:

a sinker body;

a butt extending from said sinker body for engaging said sinker cam to move said sinker between extended, intermediate and retracted positions in said knitting machine;

an upper nib protruding from said sinker body;

a lower nib protruding from said sinker body and extending further from said body than said upper nib;

a first throat defined between said upper and lower nibs, said first throat having an open end for receiving a fleece yarn, and a closed end for retaining the received fleece yarn;

first, second and third knitting platforms defined by said sinker body and being interconnected by inclined edges of said sinker body, said first knitting platform extending beyond said lower nib; and a second throat for controlling a yarn loop of a previous course knitted by said knitting machine, said second throat having an open end for receiving a loop and a closed end for retaining the previously knit loop, said second throat being defined by said lower nib and said second and third knitting platforms;

said second knitting platform of said sinker being about 0.040 inch closer to said first throat than said first knitting platform, and said third knitting platform being about 0.035 inch closer to said first throat than said second knitting platform.

* * * * *

UNITED STATES PATENT AND TRADEMARK OFFICE

CERTIFICATE OF CORRECTION

PATENT NO. : 5,477,707

DATED : December 26, 1995

INVENTOR(S) : Philip Renda, et al

It is certified that error appears in the above-identified patent and that said Letters Patent is hereby corrected as shown below:

On cover page, item [56] U.S. Patent Documents, add the following:

--1,813,849 7/1931 Guillemot 66/107
2,120,796 6/1938 Coile 66/107
4,346,572 8/1982 Guell 66/93
5,390,511 2/1995 Shibata et al. 66/92X --

Item [56] Foreign Patent Documents
--2,038,376 7/1980 Great Britain--
On cover page, References, Foreign patents, line 2, "2/1986" should be --1/1986--
Column 1, line 40, before "Typically" omit quotation mark (");
Column 1, line 48, "arch" should be --latch--;
Column 1, line 52, after "needle" insert a period (.); "in" should be --In--;
Column 2, line 11, "21" should not be bold type;
Column 4, line 62, after "positions" insert --A and B, respectively--

UNITED STATES PATENT AND TRADEMARK OFFICE
CERTIFICATE OF CORRECTION

PATENT NO. : 5,477,707 Page 2 of 2

DATED : December 26, 1995

INVENTOR(S) : Philip Renda; James Renda

It is certified that error appears in the above-identified patent and that said Letters Patent is hereby corrected as shown below:

Col. 6, line 22, after "line" insert -- A --;

Col. 7, line 33, after "line" insert -- B --;

Col. 7, line 34, after "line" insert -- A --

Col. 7, line 39, "n" should be -- L --;

Col. 7, line 56, "n" should be -- L --;

Col. 7, line 62, "n" should be -- L --;

Col. 8, line 46, "An" should be -- at --;

Col. 8, line 50, "is" should be -- Is--;

Col. 13, lines 2-3, do not indent after "said."

Signed and Sealed this

Sixteenth Day of April, 1996

Bruce Lehman

*Attest:*

BRUCE LEHMAN

*Attesting Officer*

*Commissioner of Patents and Trademarks*